US010738448B2

(12) United States Patent
Swart et al.

(10) Patent No.: US 10,738,448 B2
(45) Date of Patent: Aug. 11, 2020

(54) TOILET COUPLING

(71) Applicant: Kohler Co., Kohler, WI (US)

(72) Inventors: Peter William Swart, Oostburg, WI (US); John F. Emmerling, Howards Grove, WI (US); Scott R. Krebs, Sheboygan Falls, WI (US); Billy Jack Ahola, Manitowac, WI (US); Andrew L. Smith, Sheboygan, WI (US); Lawrence E. Duwell, Adell, WI (US); Donald G. Bogenschuetz, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/201,413

(22) Filed: Nov. 27, 2018

(65) Prior Publication Data

US 2019/0169825 A1 Jun. 6, 2019

Related U.S. Application Data

(60) Provisional application No. 62/594,395, filed on Dec. 4, 2017.

(51) Int. Cl.
*E03D 1/26* (2006.01)
*E03D 11/17* (2006.01)

(52) U.S. Cl.
CPC ..... *E03D 1/26* (2013.01); *E03D 11/17* (2013.01)

(58) Field of Classification Search
CPC ..... E03D 1/26; E03D 1/266; E03D 11/17; E03D 11/13

(Continued)

(56) References Cited

U.S. PATENT DOCUMENTS 2,108,625 A * 2/1938 Tilden ..... E03D 1/26 4/417
2,743,460 A 5/1956 Youngstrom
(Continued)

FOREIGN PATENT DOCUMENTS

CN 1514085 7/2004
CN 100419174 2/2006
(Continued)

OTHER PUBLICATIONS

Office Action Issued on CN 201811465894.6 dated Mar. 27, 2020, 17 pages with English Translation.
(Continued)

*Primary Examiner* — Benjamin R Shaw
(74) *Attorney, Agent, or Firm* — Foley & Lardner LLP

(57) ABSTRACT

A toilet that includes a tank having an outlet; a mounting bracket including a base having a central opening, a first set of mounts, which comprises two mounting locations located on opposite sides of the central opening for mounting the tank to a first pedestal having a bowl and two mounting holes, and a second set of mounts, which comprises three mounting locations that are separate from the two mounting locations of the first set of mounts, are located in a triangular pattern around the central opening, and mount the tank to a second pedestal having a bowl and three mounting holes; a valve body extending through the outlet and the central opening, wherein the valve body fluidly connects the outlet to an inlet of one of the bowls; and two or more fasteners with each fastener engaging one mounting hole and an associated mounting location.

21 Claims, 14 Drawing Sheets

(58) Field of Classification Search
USPC ..... 4/417, 240
See application file for complete search history.

(56) References Cited

U.S. PATENT DOCUMENTS

| | | | | |
|---|---|---|---|---|
| 2,930,049 | A * | 3/1960 | Minella | E03D 1/26 4/417 |
| 2,996,728 | A * | 8/1961 | Minella | E03D 1/26 4/419 |
| 3,142,845 | A | 8/1964 | Fulton | |
| 3,267,491 | A | 8/1966 | Snyder | |
| 3,669,171 | A | 6/1972 | Yavitch | |
| 4,240,606 | A | 12/1980 | Johnson | |
| 4,757,560 | A | 7/1988 | Grimstand | |
| 4,850,063 | A | 7/1989 | Abbate | |
| 4,907,301 | A | 3/1990 | Tucker | |
| 4,924,533 | A | 5/1990 | Stairs, Jr. | |
| 5,295,273 | A | 3/1994 | Unger | |
| 6,725,468 | B2 | 4/2004 | Molina | |
| 6,728,976 | B1 | 5/2004 | Halloran et al. | |
| 7,913,328 | B2 | 3/2011 | Halloran | |
| 9,487,937 | B2 | 11/2016 | Swart | |
| 9,809,967 | B1 * | 11/2017 | Conrad | E03D 11/02 |
| 2006/0225191 | A1 * | 10/2006 | Chen | E03D 1/26 4/252.1 |
| 2008/0066223 | A1 | 3/2008 | Halloran | |
| 2013/0312172 | A1 * | 11/2013 | Swart | E03D 11/17 4/378 |
| 2016/0102450 | A1 | 4/2016 | Jensen | |

FOREIGN PATENT DOCUMENTS

| | | |
|---|---|---|
| CN | 200720119109 | 3/2007 |
| CN | 200910203241 | 5/2009 |
| CN | 202294603 U | 7/2012 |
| CN | 103422563 | 12/2013 |
| CN | 204028749 U | 12/2014 |
| CN | 206361370 U | 7/2017 |
| CN | 209907516 | 1/2020 |
| DE | 27 24 413 | 12/1978 |
| EP | 2128351 | 12/2009 |
| GB | 787817 | 12/1957 |

OTHER PUBLICATIONS

Chinese Office Action for Chinese Application No. 201811465894.6 dated Mar. 27, 2020.

* cited by examiner

TOILET COUPLING

CROSS-REFERENCE RELATED TO PATENT APPLICATIONS

The present application claims the benefit of and priority to U.S. Provisional Patent Application No. 62/594,395, which was filed on Dec. 4, 2017, and is incorporated by reference herein in its entirety.

BACKGROUND

The present application relates generally to the field of two piece toilets. More specifically, the application relates to improved toilet couplings that secure a toilet tank to a separate toilet bowl for two piece toilets.

SUMMARY

At least one embodiment of this application relates to a toilet that includes a tank, a universal mounting bracket, a valve body, and two or more fasteners. The tank has an outlet in a bottom. The universal mounting bracket includes a base having a central opening, a first set of mounting locations, and a second set of mounting locations. The first set of mounting locations includes two mounting locations that are located on opposite sides of the central opening and are configured to mount the tank to a first pedestal having a bowl and two mounting holes. The second set of mounting locations includes three mounting locations that are separate from the two mounting locations of the first set of mounting locations, are located in a triangular pattern around the central opening, and are configured to mount the tank to a second pedestal having a bowl and three mounting holes. The valve body extends through the outlet and the central opening, wherein the valve body is configured to fluidly connect the outlet of the tank to an inlet of one of the bowls (of the first or second pedestals). Each fastener engages one mounting hole and an associated mounting location to secure the mounting bracket to associated pedestal.

At least one embodiment of this application relates to a toilet that includes a tank, a pedestal, a universal mounting bracket, and a seat. The pedestal has a ledge, a bowl, and an inlet fluidly connected to the bowl. The universal mounting bracket includes a base having at least two mounting locations, and an arm extending away from the base. A fastener engages each mounting location of the mounting bracket and an associated mounting hole in the ledge to secure the mounting bracket to the pedestal. The seat is movably (e.g., rotatably, slidably, etc.) coupled to the arm through a hinge, such that the seat is movable (e.g., rotatable, slidable, etc.) relative to the mounting bracket and pedestal.

At least one embodiment of this application relates to a toilet that includes a tank having an outlet, a bowl having an inlet, a mounting bracket comprising a base and a sleeve, at least two fasteners, and a valve body. The base is located between the tank and the bowl, and the base has a central opening and at least two mounting locations. The sleeve extends away from the base and is located concentric to the central opening; and the sleeve has internal threads. One fastener is associated with each of the at least two mounting locations and is configured to engage the bowl to secure the mounting bracket to the bowl. The valve body extends through the outlet, the sleeve, and the central opening to fluidly connect the inlet of the bowl to the tank; and the valve body has external threads that thread to the internal threads to secure the valve body and the tank to the mounting bracket.

At least one embodiment of this application relates to a tank mounting assembly that includes a mounting bracket, which has a base and a sleeve, and at least two fasteners. The base is configured to be located between a toilet tank and a toilet bowl; and the base has a central opening and at least two mounting locations disposed the central opening. The sleeve extends away from the base and is located concentric to the central opening; and the sleeve has internal threads that are configured to thread to a valve body (of a toilet). One fastener is associated with each of the at least two mounting locations and configured to engage the toilet bowl to secure the mounting bracket to the toilet bowl.

DETAILED DESCRIPTION

Referring generally to the FIGURES, disclosed in this application are coupling systems (e.g., coupling assemblies, toilet couplings, toilet coupling assemblies, etc.) for securing toilet tanks to toilet bowls for two-piece toilets. At least one embodiment of the coupling systems can be used for three mount systems; and at least one embodiment of the coupling systems can be used for two mount systems. Some embodiments of the coupling systems are universal mounts and, therefore, can be used with three mount systems and with two mount systems.

Figure 1:
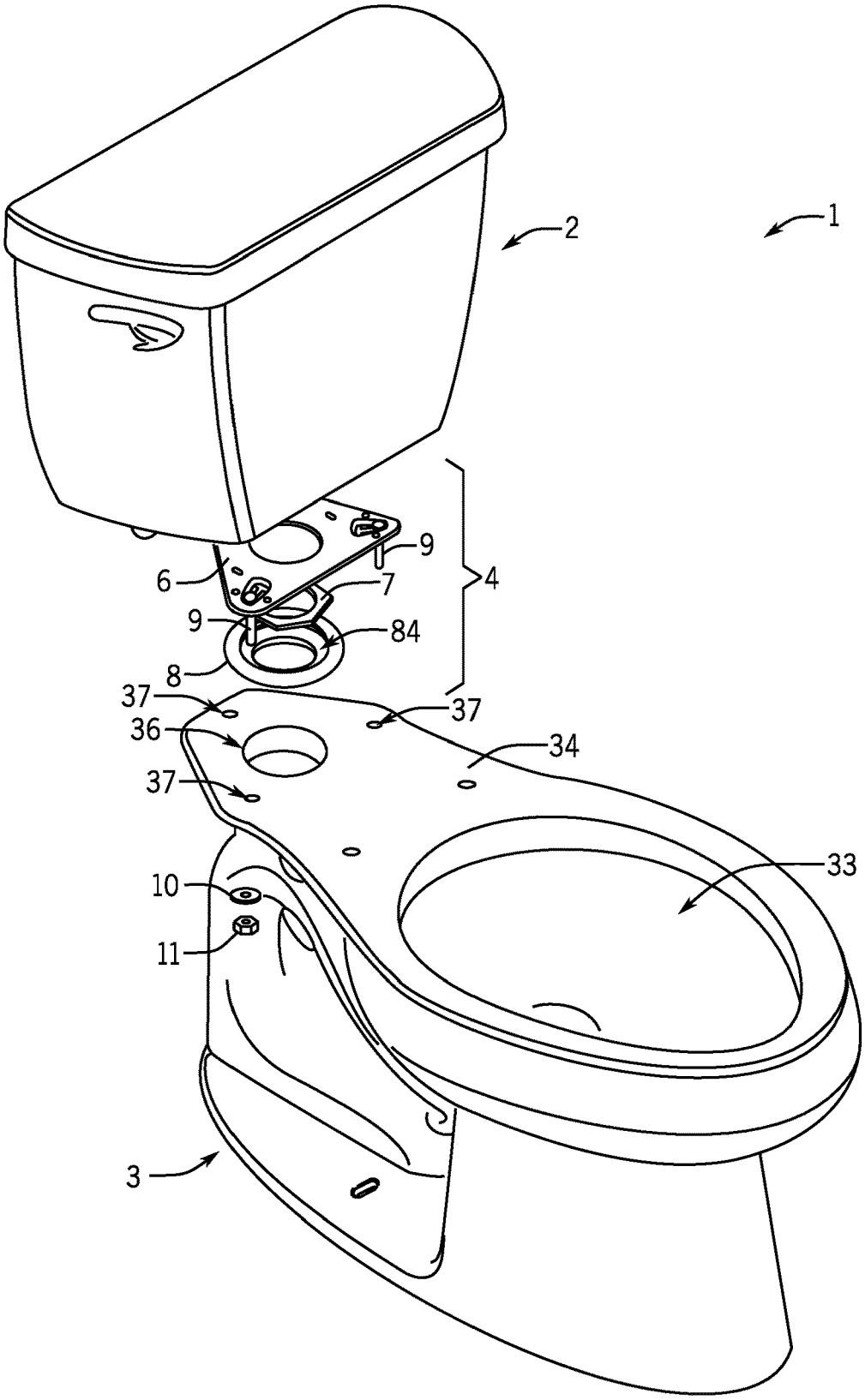
FIG. 1 (PRIOR ART)
FIG. 1 is a front exploded perspective view of a toilet having a toilet coupling that secures a toilet tank to a toilet pedestal at three locations.
Figure 2:
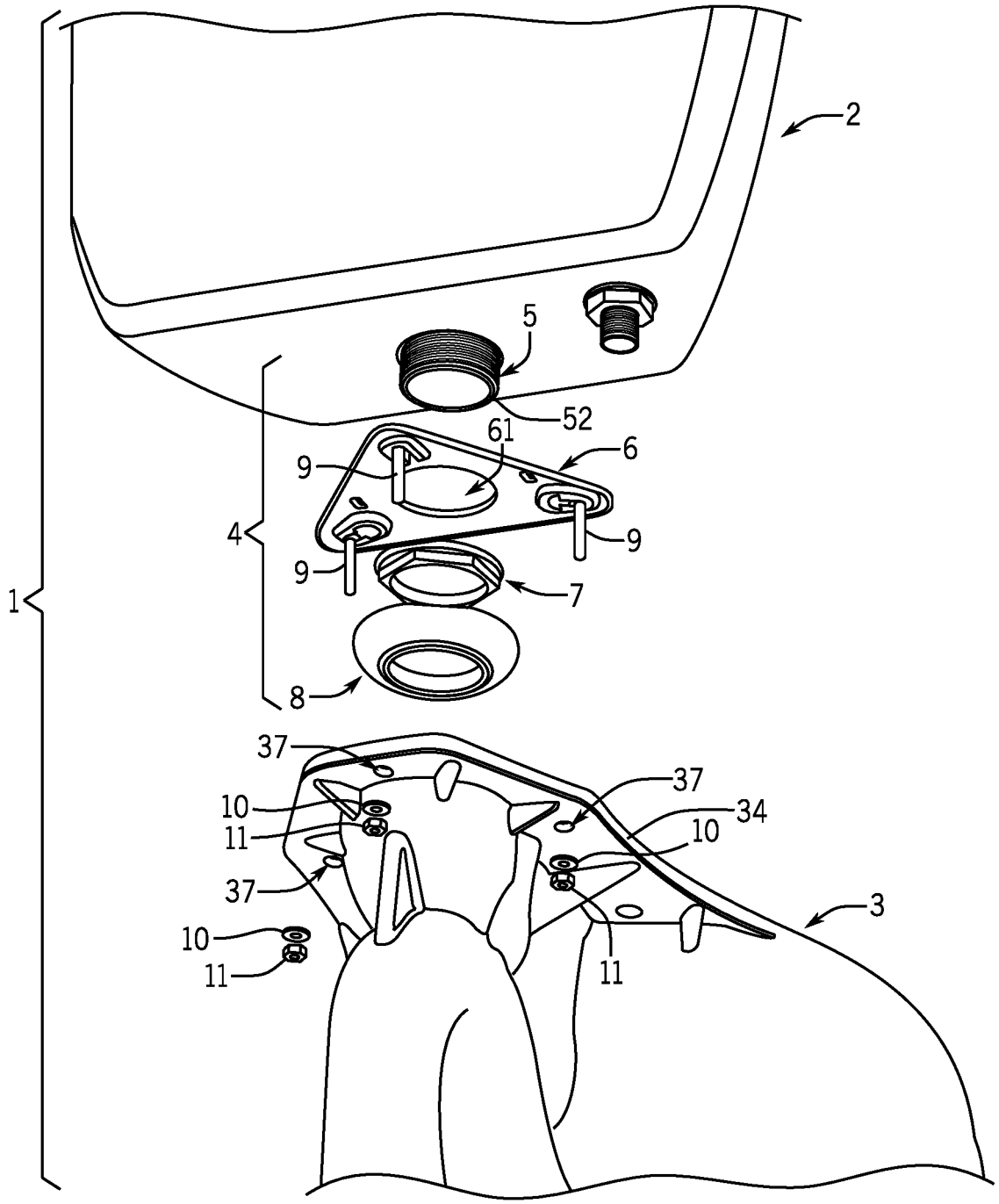
FIG. 2 (PRIOR ART)
FIG. 2 is a rear exploded perspective view of the toilet shown in FIG. 1.

FIGS. 1 and 2 illustrate a toilet coupling 4 (e.g., an attachment assembly) for securing a tank 2 of toilet 1 to a pedestal 3 (e.g., bowl) of the toilet 1 at three locations, according to U.S. Pat. No. 9,487,937, which issued Nov. 8, 2016 and is incorporated by reference herein in its entirety. The toilet coupling 4 includes a valve 5 (e.g., a flush valve assembly), a mounting bracket 6, a valve nut 7, and a gasket 8 (e.g., grommet). The mounting bracket 6 includes three mounting locations spaced apart around a central opening 61 that receives an end 52 of a valve body of the valve 5. Each mounting location is secured to the ledge 34 of the pedestal, which is rearward of a bowl opening 33 of the pedestal 3, using a fastener 9 (e.g., bolts, screws, rivets, etc.) that extends through an opening in the mounting bracket 6 and an opening 37 in the ledge 34. Each fastener 9 can be secured to the pedestal using a washer 10 and a nut 11.

Figure 3:
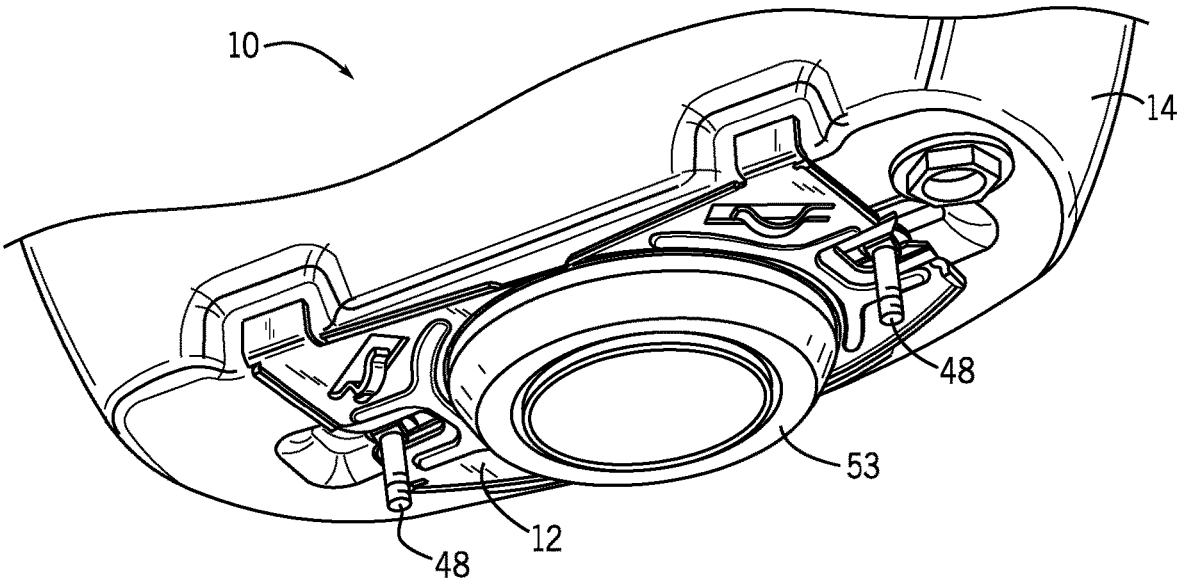
FIG. 3 (PRIOR ART)
FIG. 3 is a perspective view of a toilet tank and a coupling assembly configured to secure a toilet tank to a toilet pedestal at two locations.
Figure 4:
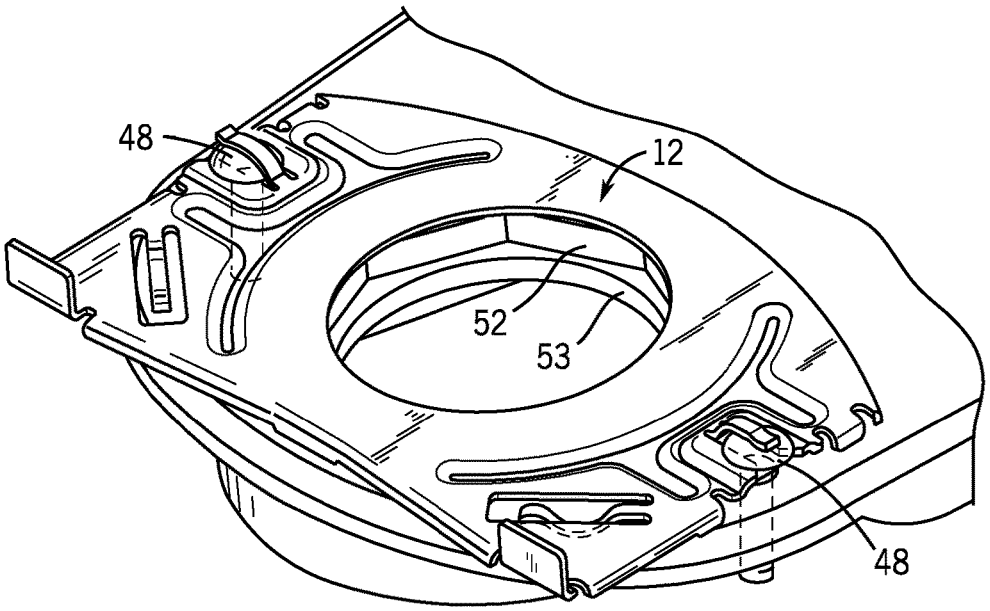
FIG. 4 (PRIOR ART)
FIG. 4 is a perspective view of a toilet bowl and the coupling assembly of FIG. 3 configured to secure a toilet tank to a toilet pedestal at two locations.

FIGS. 3 and 4 illustrate a toilet coupling for securing a tank 14 of toilet 10 to a pedestal 18 of the toilet 10 at two locations, according to U.S. Pat. No. 6,728,976, which issued May 4, 2004 and is incorporated by reference herein in its entirety. The toilet coupling includes a bracket 12 having two holes located side by side on opposite sides of a central opening, where each of the two holes receives one of two bolts 48 to couple the bracket 12 to the pedestal 18 of the toilet 10. The bracket 12 is secured to the bottom of the tank 14 using a valve nut 52. A gasket 53 can be disposed over the valve nut 52 after the nut is secured to a valve.

Most two piece toilets utilize either the two side-by-side mounting locations as shown in FIGS. 3 and 4 or the three triangular mounting locations as shown in FIGS. 1 and 2. A universal bracket that could be used on toilets having the two mounting locations and toilets having the three mounting locations would advantageously eliminate the need for different brackets on different toilets. Such universal brackets could also be employed in aftermarket systems, since the brackets could be used with both two and three mount systems.

Figure 5:
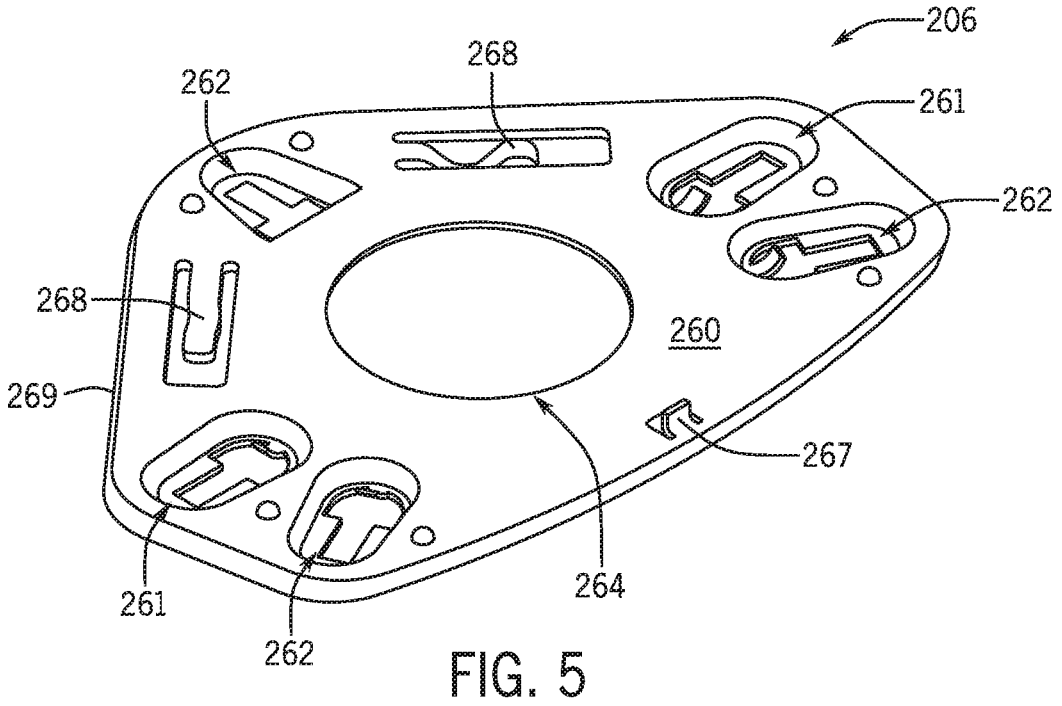
FIG. 5 is a perspective view of an exemplary embodiment of a universal mounting bracket of a toilet coupling.
Figure 6:
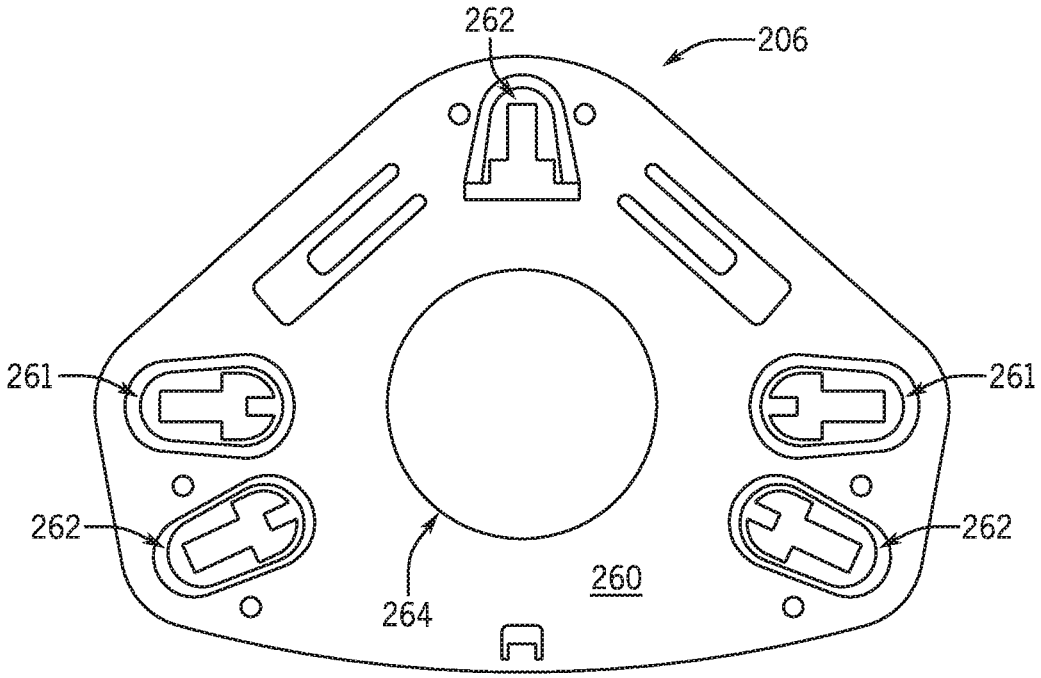
FIG. 6 is a plan view of the mounting bracket shown in FIG. 5.
Figure 7:
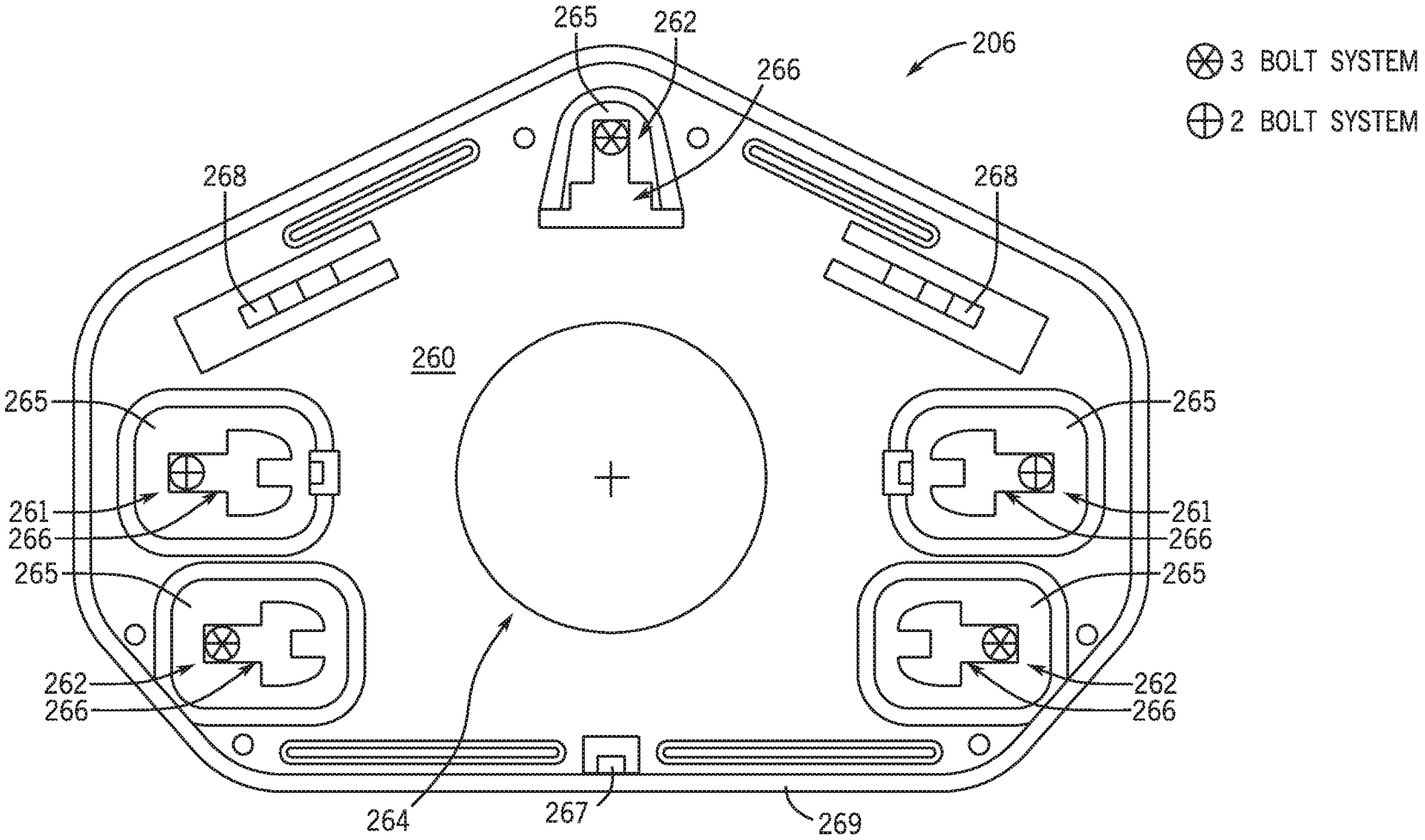
FIG. 7 is another plan view of the mounting bracket shown in FIG. 5 showing the mounting locations for use with two attachment systems and for use with three attachment systems.

FIGS. 5-7 illustrate an exemplary embodiment of a universal mounting bracket 206 that is configured for use with two mounting location toilets and three mounting location toilets, such as the toilets 1, 10 shown in FIGS. 1-4. The mounting bracket 206 includes a generally flat base 260, a first plurality (e.g., first set) of mounting locations 261, and a second plurality (e.g., second set) of mounting locations 262 that are separate from the first plurality of mounting locations 261. As shown in FIG. 7, the first plurality of mounting locations 261 includes two mounting locations disposed on opposite sides of an opening 264 (e.g., a central opening) in the base 260 and, therefore, are configured for use with toilet pedestals having the two side-by-side mounting locations, such as two mount pedestals using systems like that shown in FIGS. 3 and 4. Also shown in FIG. 7, the second plurality of mounting locations 262 includes three mounting locations disposed around the opening 264 in a generally triangular arrangement (e.g., pattern) and, therefore, are configured for use with toilet pedestals having three triangularly arranged mounting locations, such as three mount pedestals using systems like that shown in FIGS. 1 and 2. A first mounting location of the first set of mounting locations 261 is located adjacent to a first mounting location of the second set of mounting locations 262; and a second mounting location of the first set of mounting locations 261 is located adjacent to a second mounting location of the second set of mounting locations 262. A third mounting location of the second set of mounting locations 2626 is located adjacent to a rearward edge or portion of the base 260. The third mounting location can be substantially aligned with a center of the opening 264 in a fore and aft direction. The first and second mounting locations of the first set of mounting locations 261 can be substantially aligned with the center of the opening 264 in a lateral direction. The first and second mounting locations of the second set of mounting locations 262 are provided forward of the first and second mounting locations of the first set of mounting locations 261 in the fore and aft direction, such as proximate a forward edge or portion of the base 260. Each mounting location 261, 262 includes a mounting surface 265 offset from the base 260 toward the pedestal and an opening 266 in the mounting location 261, 262 that receives a fastener for securing the mounting bracket 206 to the pedestal.

The opening 264 in the base 260 of the mounting bracket 206 is configured to accommodate a flow of flush water from the tank to the bowl, such as through a valve, and therefore can receive part of the valve, such as a valve body, during coupling the tank to the pedestal. Thus, the size of the opening 264 can be tailored to the size of the part of the valve that extends through the opening 264. A valve nut can be provided to couple (e.g., screws) to the valve body to secure (e.g., clamp) the mounting bracket 206 to the bottom of the toilet tank. Alternatively, a sleeve, such as disclosed herein for other embodiments, can be provided to secure the valve body and the tank to the mounting bracket 206.

The mounting bracket 206 can include a tab (e.g., offset finger) that can engage either part of the toilet tank or part of the toilet pedestal for alignment and/or anti-rotation of the mounting bracket 206. As shown, the mounting bracket 206 includes a tab 267, which is located along a front (e.g., front side) of the base 260 that is opposite the third mounting location of the second set of mounting locations 262 and is between the two front mounting locations 262 (for the three mount systems), and also includes two tabs 268, with each tab 268 located on one side (e.g., first and second, left and right, etc.) between the third mounting location (i.e., the rear mounting location 262 for the three mount system) and one of the mounting locations 261 (for the two mount system). As shown best in FIG. 5, each tab 268 includes a portion that is bent away from the base 260, such that the bent away portion can engage a feature (e.g., recess, notch, etc.) in the bottom of the tank or the top of the pedestal. The tab 267 can, for example, extend in an opposite direction (e.g., upward) as the direction (e.g., downward) of the other tabs 268 to engage the other of the tank and the pedestal.

Also shown in FIGS. 5-7, the mounting bracket 206 includes a flange 269 extending around an entire outer profile (e.g., outer periphery) of the bracket. However, the flange 269 can be configured to extend around one or more portions of the outer profile. The flange 269 extends from the base 260 toward the pedestal, and can be configured to contact the pedestal or have a gap therebetween when assembled. The flange provides increase strength and stability to the mounting bracket 206 and the toilet coupling. The mounting bracket 206 can include one or more arms that are configured to couple to a toilet seat, and each arm can be coupled to the base 260 and/or to the flange 269 if provided.

Figure 8:
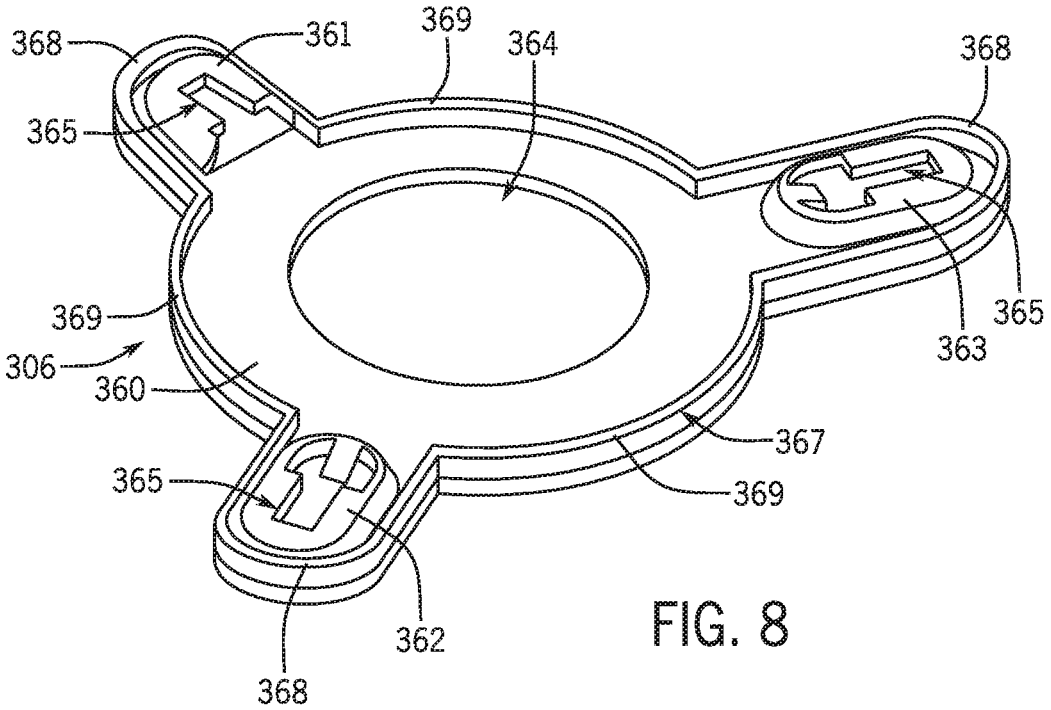
FIG. 8 is a perspective view of an exemplary embodiment of a mounting bracket for use securing a toilet tank to a toilet pedestal.
Figure 9:
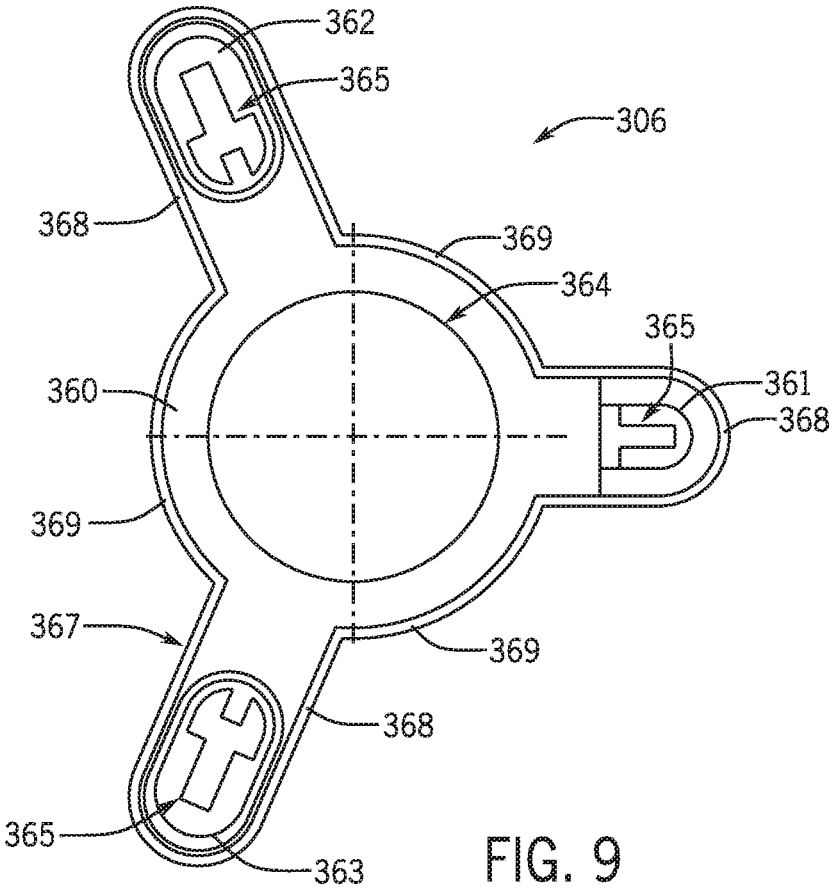
FIG. 9 is a plan view of the mounting bracket shown in FIG. 8.

FIGS. 8 and 9 illustrate an exemplary embodiment of a mounting bracket 306 for use with an attachment assembly (e.g., the attachment assembly 4) that secures a toilet tank (e.g., the tank 2) to a toilet bowl (e.g., the bowl 3). For example, the mounting bracket 306 can be used with the valve 5, the valve nut 7, the gasket 8, and/or the fasteners shown in FIGS. 1-4 to secure the tank 2 to the bowl 3 such that the valve 5 is fluidly connected to the inlet opening 36 of the bowl 3. It is noted that the mounting bracket 306 can also be used to secure other toilet tanks to other three mount toilet bowls.

The mounting bracket 306 includes a substantially circular body 360 and three arms 361, 362, 363 extending radially outward from the body 360 in different directions. As shown, the three arms 361, 362, 363 would generally form a Y-shape absent the circular body 360. Disposed centrally in the body 360 is an opening 364 that is configured to accommodate a flow of flush water from the tank to the bowl, such as through a valve, and therefore can receive part of a valve (e.g., the valve 5, a body thereof, etc.) during assembly to fluidly couple a toilet tank to a toilet bowl. Each of the three arms 361, 362, 363 includes a mounting location 365 for securing the mounting bracket 306 to part of a toilet bowl. Thus, the mounting bracket 306 is configured for use with three mount toilet bowls. Each mounting location 365 of the mounting bracket 306 can be configured according to any of the mounting locations disclosed in this application (e.g., the mounting location 62, the mounting location 262, etc.) or a combination of one or more features from two or more of the mounting locations disclosed in this application. For example, each mounting location 365 includes an opening, such as described for other embodiments, that receives a fastener that couples the mounting bracket 306 to a toilet bowl.

Also shown in FIGS. 8 and 9, a flange 367 extends around an outer profile (e.g., an outer periphery) of the mounting bracket 306. The flange 367 includes three arm portions 368, each of which extends around one of the three arms 361, 362, 363, and three semi-circular portions 369, each of which extends around part of the body 360 between two arm portions 368. Each arm portion 368 is shown generally U-shaped (as viewed in FIG. 9) and extending around part or all of the outer profile of the associated arm 361, 362, 363. Each semi-circular portion 369 extends around part of the outer profile of the circular body 360 and is shown coupled to one end of each of two adjacent arm portions 368. The semi-circular portions 369 can be concentric with (or eccentric to) the opening 364 and can have an inner radius that is tailored to an outer diameter of the gasket 8. By way of example, the inner surface (i.e., the surface facing radial inward) of the portions 369 can contact an outside of the gasket upon assembly. The location and arrangement (e.g., shape, length, etc.) of the semi-circular portions 369 can advantageously support and/or retain a gasket (e.g., the gasket 8 shown in FIGS. 1 and 2, the gasket 53 shown in FIGS. 3 and 4) in place during assembly and/or can provide support to the valve body (which the gasket is mounted on) through the gasket. By supporting the valve body with the circular portions 369 (e.g., through the gasket), the valve body can be made with relatively lower strength and lower cost materials.

The arm portions 368 advantageously increase the strength of the mounting bracket 306 through the arms 361, 362, 363; and the overall arrangement of the mounting bracket 306 advantageously reduces the weight over, for example, the triangular shaped mounting brackets. The mounting bracket 306 also provides stability both during and after the toilet tank is secured to the toilet bowl of the toilet, allows for easy adjustability of the toilet tank relative to the toilet bowl, such as through adjustment of one or more of the fasteners coupling the mounting bracket 306 to the toilet bowl through the mounting locations 365, and eliminates the issue of having leaks around fasteners that extend through the toilet tank (e.g., the bottom wall of the tank).

Figure 10:
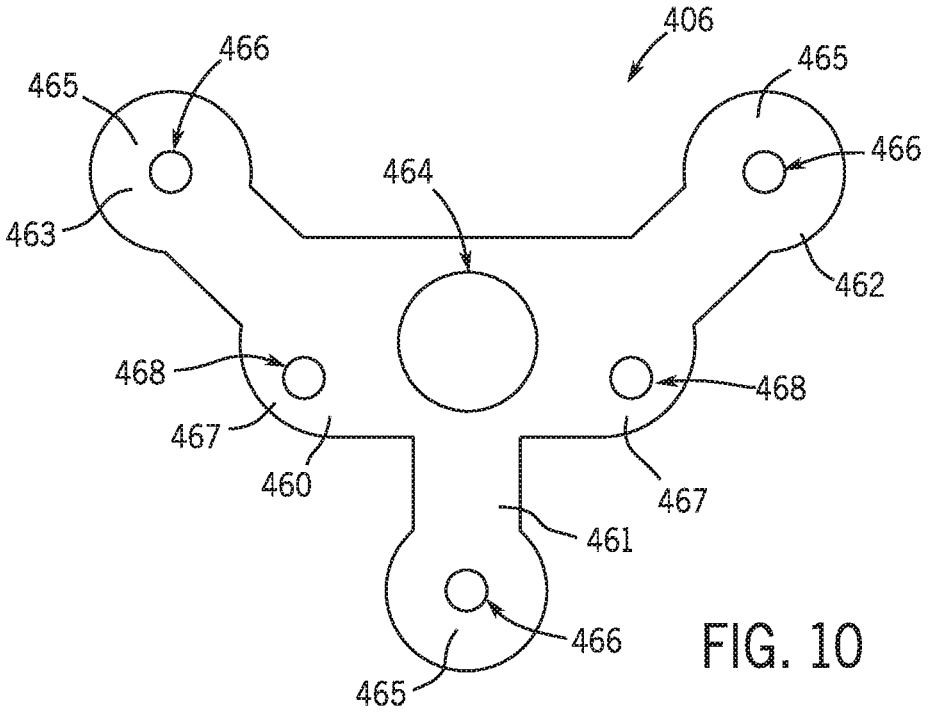
FIG. 10 is a plan view of an exemplary embodiment of a universal mounting bracket.

FIG. 10 illustrates an exemplary embodiment of a universal mounting bracket 406 that provides attachment for both two and three mount systems (e.g., the toilets 1, 10 shown in FIGS. 1-4) and that has been reduced in size and weight. The mounting bracket 406 includes a base 460 and three arms 461, 462, 463 extending away from the base 460 in different directions. An opening 464 in the base 460 is configured to receive a valve body during assembly or otherwise fluidly connect a tank to a bowl. Each arm 461, 462, 463 includes a mounting location 465 having an opening 466 for coupling the mounting bracket 406 to a pedestal of a toilet, such as through a fastener. The three mounting locations 465 are arranged generally in a triangular arrangement around the opening 464 in the base 460 and, therefore, are configured to couple the mounting bracket 406 to pedestals having three triangular mounts. The base 460 includes two mounting locations 467 disposed on opposite sides of the opening 464, where each mounting location 467 includes an opening 468 for coupling the mounting bracket 406 to a pedestal through a fastener. The two mounting locations 467 and openings 468 are arranged side-by-side on opposite sides of the opening 464 and, therefore, are configured to couple the mounting bracket 406 to pedestals having two side-by-side mounts. It is noted that the mounting bracket 406 can include other features (e.g., a flange around part or all of an outer profile of the bracket).

Figure 11:
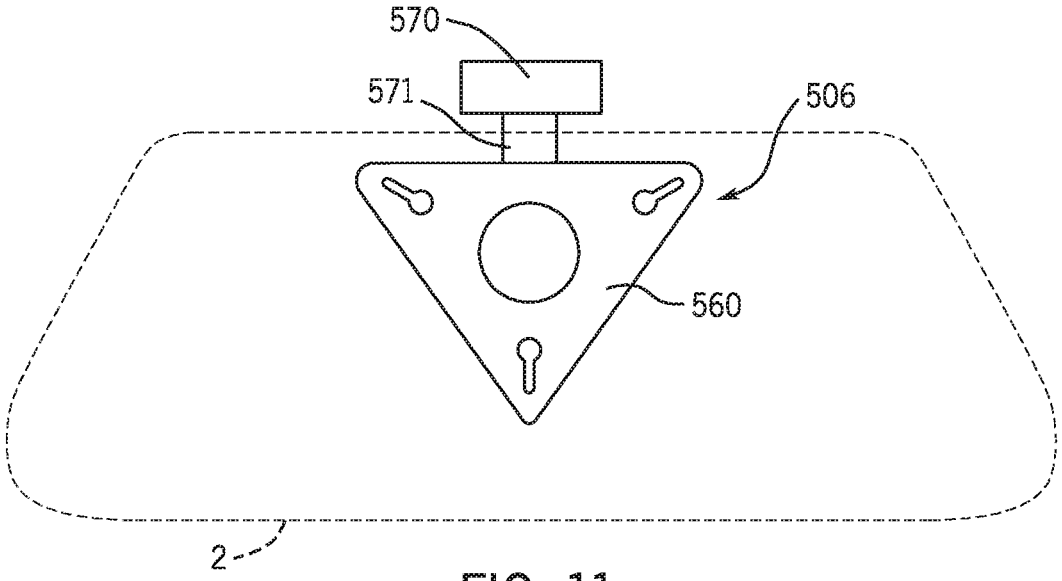
FIG. 11 is a top view of an exemplary embodiment of a mounting bracket.

FIG. 11 illustrates an exemplary embodiment of a mounting bracket 506 for coupling a tank to a pedestal. The mounting bracket 506 includes a base 560 and a holder 570 (e.g., an electronic holder) coupled to an edge of the base 560 through a web 571. The base 560 can be configured according to any embodiment disclosed herein (3 mount or two mount). The electronic holder 570 can be configured to hold/support, for example, a phone, a battery, or other suitable device. The web 571 extends outward beyond an outer wall of the tank so that the electronic holder 570 is accessible by a user of the bathroom/toilet. For example, the web 571 can be a generally rectangular member extending from an edge of the base 560 to an edge of the holder 570. Although, the mounting bracket 506 is shown having three mounting locations, the mounting bracket 506 can be configured having two mounting locations for two mount toilets or as a universal bracket. Further, any other embodiment disclosed in this application can include the holder 570 or similar element.

Figure 12:
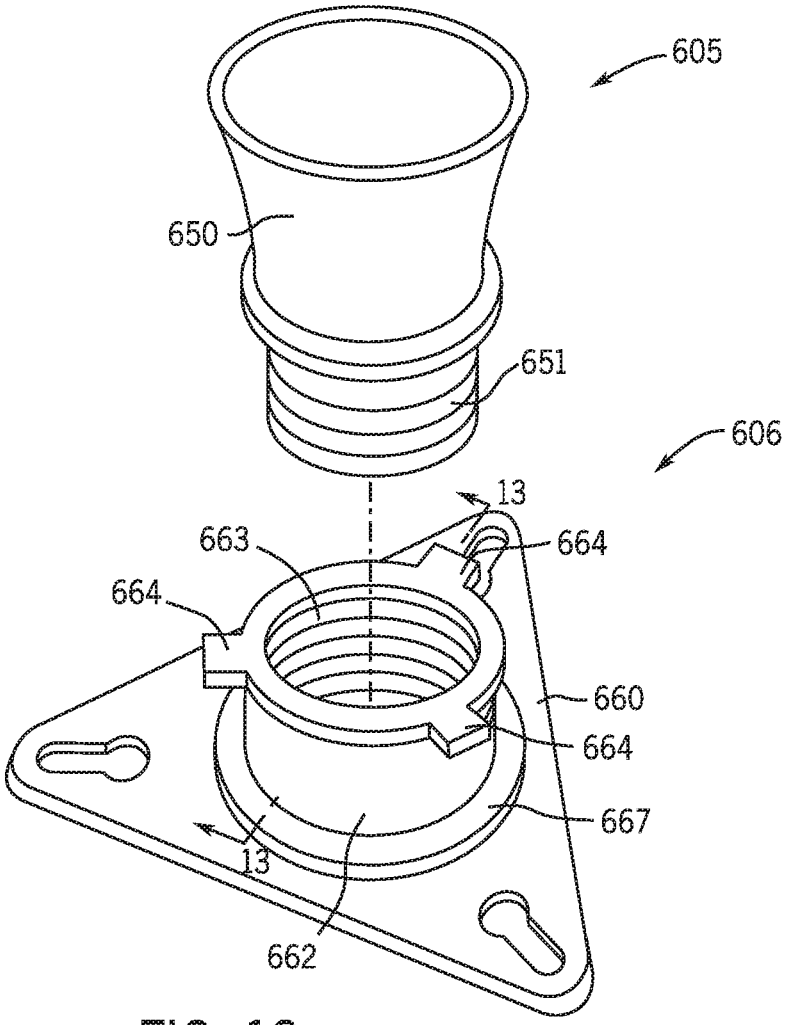
FIG. 12 is a perspective view of an exemplary embodiment of a mounting bracket and a flush valve base.
Figure 13:
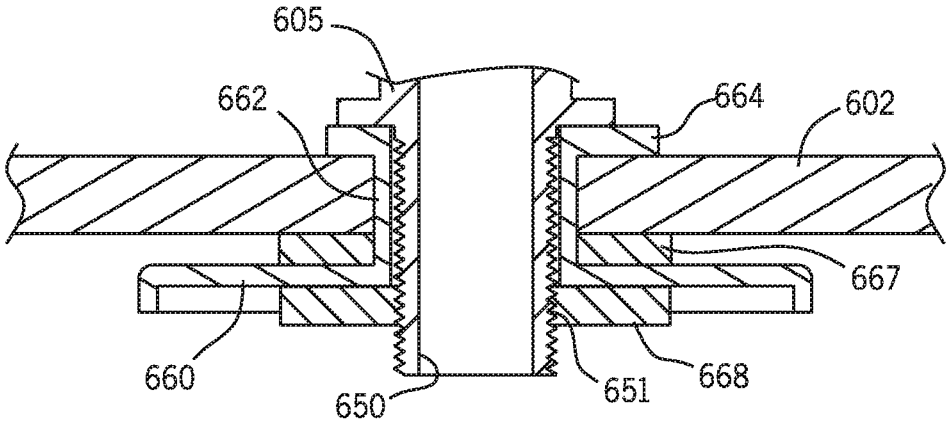
FIG. 13 is a side cross-sectional view of the mounting bracket shown in FIG. 12.

FIGS. 12 and 13 illustrate an exemplary embodiment of a mounting bracket 606 for coupling a tank (e.g., tank 2) to a pedestal (e.g., pedestal 3) for a toilet. The mounting bracket 606 includes a base 660, which can be configured as a two mount, a three mount, or a universal mount bracket. The mounting bracket 606 also includes an integrated sleeve 662 extending upwardly from the base 660 toward the tank, where the sleeve 662 is configured to couple to a flush valve body 605. As shown in FIG. 12, the sleeve 662 includes internal threads 663 that thread to external threads 651 on a cylindrical portion 650 of the valve body 605 to secure the mounting bracket 606 to the valve body 605. The sleeve 662 can also include one or more radial tabs 664 that extend radially outward from the sleeve 662. The mounting bracket 606 is shown including three radial tabs 664 arranged approximately 120° (one-hundred and twenty degrees) apart, but it is noted that the bracket can include a fewer or a greater number of tabs, which can be arranged at similar or different angles relative to one another. The tabs 664 can be configured to limit and/or prohibit rotation of the bracket relative to another component (e.g., a valve, a tank, etc.). As shown in FIG. 13, the tabs 664 can be inserted into openings in a bottom of tank 602, then rotated by an angle to lock the mounting bracket 606 in place relative to the tank 602. The mounting bracket 606 can be employed with one or more gaskets. Also shown in FIG. 13, a first gasket 667 is disposed around the sleeve 662 at a location that is above the base 660 and below the tabs 664 and the tank 602; and a second gasket 668 is disposed below the base 660, which can, for example, engage the inlet opening in the pedestal/bowl (e.g., the opening 36 shown in FIG. 1). The integrated sleeve 662 and base 660 of the mounting bracket 606 can advantageously increase the strength and durability of the toilet coupling while simplifying assembly. The sleeve 662 can be integrally formed with the base 660 or alternatively, the sleeve 662 can include external threads (provided on a side opposite the tabs 664) that thread to internal threads in the base 660. Although the mounting bracket 606 is shown having three mounting locations, it is noted that the mounting bracket 606 can have two mounting locations for two mount toilets or can be a universal bracket.

Figure 14:
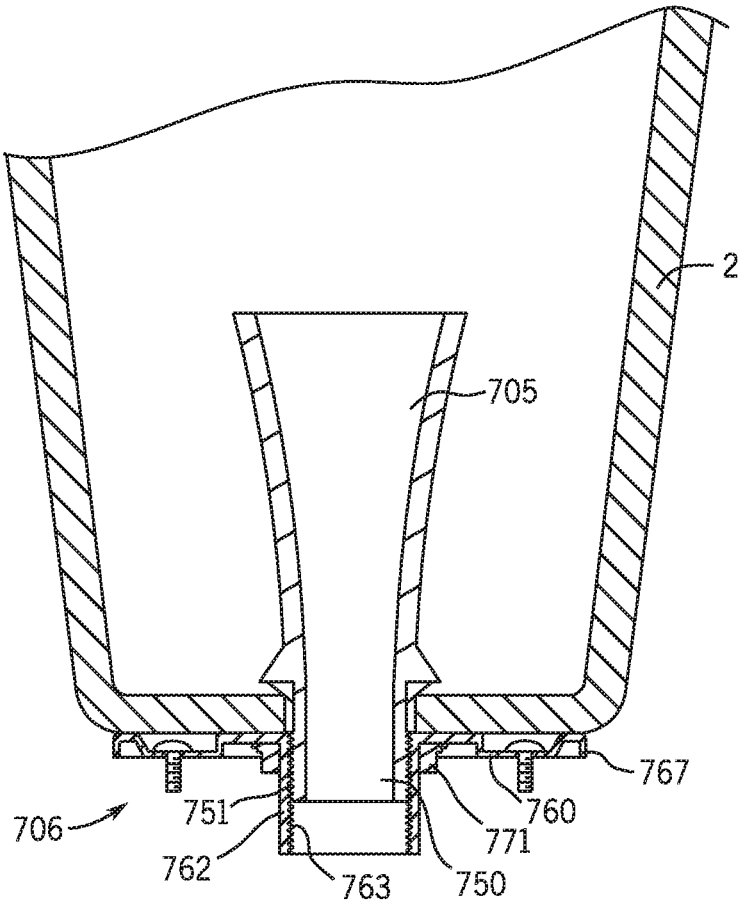
FIG. 14 is a front cross-sectional view of an exemplary embodiment of a mounting bracket coupled to a valve body in a tank.
Figure 15:
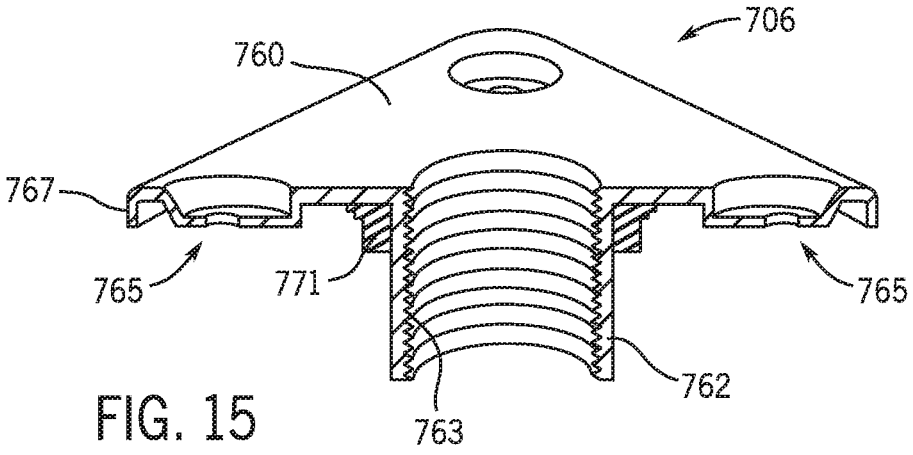
FIG. 15 is a cross-sectional perspective view of the mounting bracket shown in FIG. 14.

FIGS. 14 and 15 illustrate an exemplary embodiment of a mounting bracket 706 having a base 760 and a sleeve 762 integrated (e.g., integrally formed) with the base 760. The bracket can be rigid (e.g., made from a metal or other similar strength material). As shown, the sleeve 762 is a generally cylindrical element that extends downwardly from the bottom of the base 760 and includes internal threads 763 for threading to external threads 751 on a valve body 750 of a flush valve 705. The sleeve 762 can be threaded onto the valve body 750 until a top of the base 760 is proximate to (e.g., contacting) the bottom of the tank 2. The base 760 includes mounting locations 765 (e.g., two, three, five, etc.) for coupling the mounting bracket 706 to a toilet pedestal. The base 760 can include a flange 767 that extends downwardly around a profile (e.g., part or all of an outer profile) of the base 760. Thus, the flange 767 and the sleeve 762 can extend in the same direction (e.g., toward the toilet pedestal). One or more gaskets can be employed with the mounting bracket 706. For example, a first gasket 771 can be located underneath the base 760 and around the sleeve 762 to seal an opening in a pedestal. Also, for example, a gasket (e.g., second gasket) can be disposed around a portion of the valve body 750 between the base 760 and the bottom of the tank 2. The integrated sleeve and base of the mounting bracket 706 can increase the strength and durability of the toilet coupling while simplifying assembly. For example, the sleeve supports the valve body, such as to eliminate the valve nut, which can be a weak point in the assembly, and the cost associated with the nut.

Figure 16:
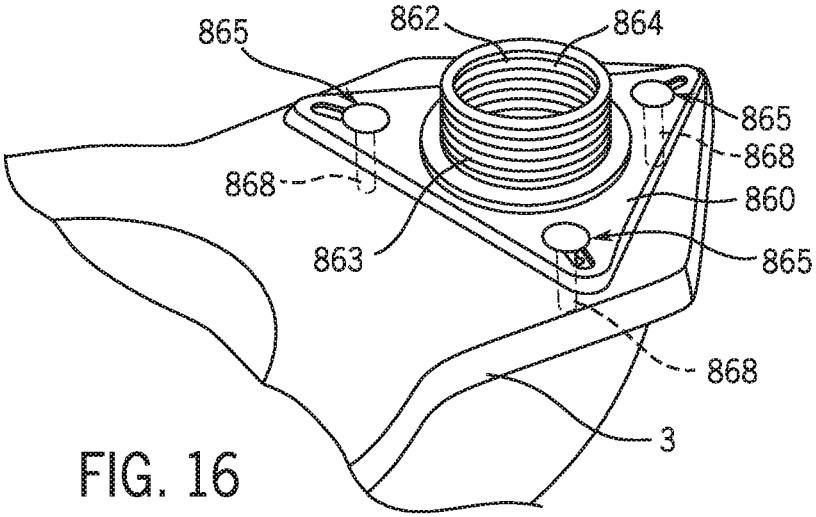
FIG. 16 is a perspective view of an exemplary embodiment of a mounting bracket coupled to a pedestal.
Figure 17:
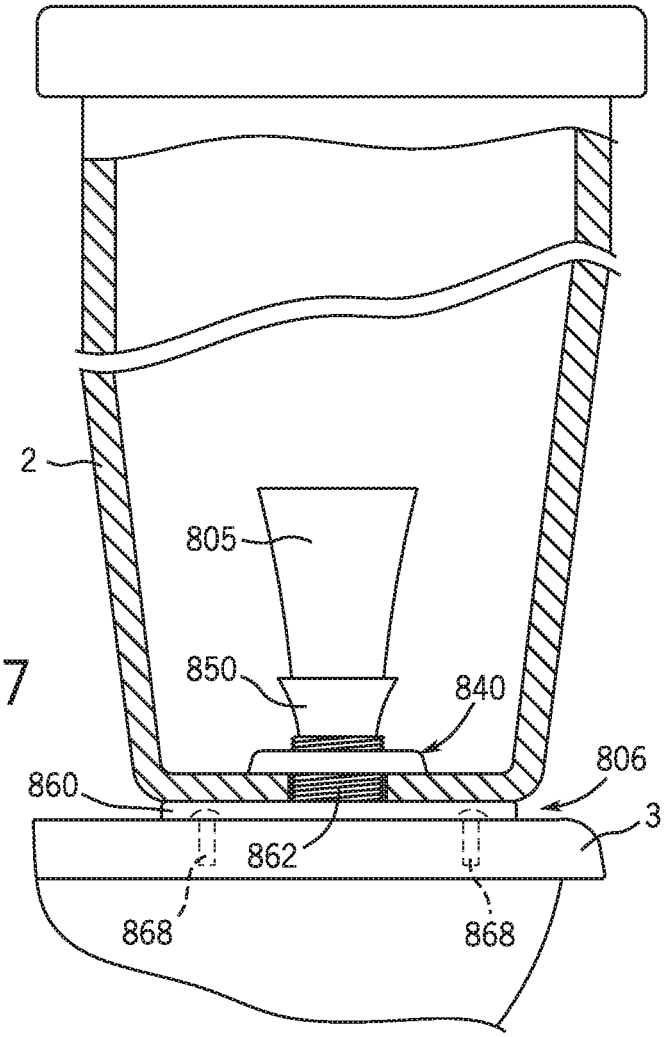
FIG. 17 is a side cross-sectional view of the mounting bracket shown in FIG. 16 coupling a tank to a pedestal.

FIGS. 16 and 17 illustrate an exemplary embodiment of a mounting bracket 806 having a base 860 and a sleeve 862 integrated with the base 860. As shown, the sleeve 862 extends upwardly from the base 860 and includes external threads 863 and/or internal threads 864 for threading to mating threads on a retaining nut 840 (e.g., attachment nut) and/or a valve body 850 of a flush valve 805. For example, internal threads of the retaining nut 840 can thread to the external threads 863 of the sleeve 862 with the retaining nut 840 on the inside of the tank 2 and the base 860 outside of the tank 2 (e.g., below the bottom of the tank) to secure the mounting bracket 806 to the tank 2. Also, for example, external threads of the valve body 850 can thread to the internal threads 864 of the sleeve 862 to secure the flush valve 805 to the mounting bracket 806. A plurality of mounting locations 865 (e.g., two, three, five, etc.) can be disposed in the base 860 for coupling the mounting bracket 806 to the pedestal. Thus, although the mounting bracket 806 is shown in FIG. 16 having three mounting locations, the mounting bracket 806 can have two mounting locations for two mount toilets, can be a universal bracket, or can have any number of mounting locations. During assembly, a fastener 868 can be disposed in each mounting location 865, such as prior to securing the mounting bracket 806 to the tank through the retaining nut 840, and the mounting bracket 806 can be inserted into the opening (e.g., fluid outlet) in the bottom of the tank 2. The retaining nut 840, if provided, can be screwed onto the external threads 864 of the sleeve 862 to secure the mounting bracket 806 to the tank 2. The retaining nut 840 can also seal the opening in the bottom of the tank 2. A gasket can optionally be employed for the seal between the retaining nut 840, the sleeve 862, and the tank 2. The flush valve 805 can be coupled to the sleeve 862, such as threaded thereto as discussed above; and the mounting bracket 806 can be secured to the pedestal, such as through the fastener(s) 868, with the flush valve 805 fluidly connecting the tank outlet to the pedestal inlet (e.g., the opening 36).

Figure 18:
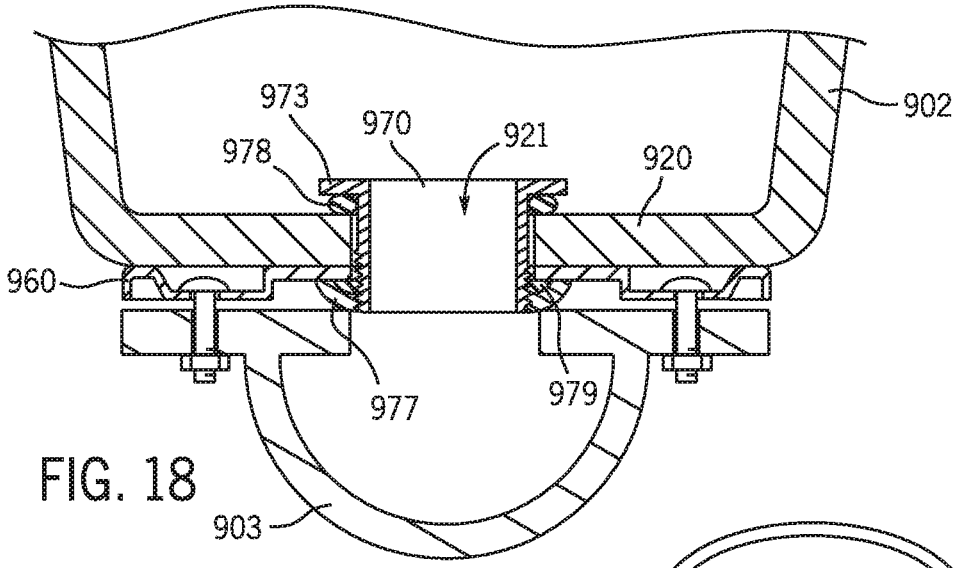
FIG. 18 is a front cross-sectional view of an exemplary embodiment of a mounting bracket coupling a tank to a bowl.
Figure 19:
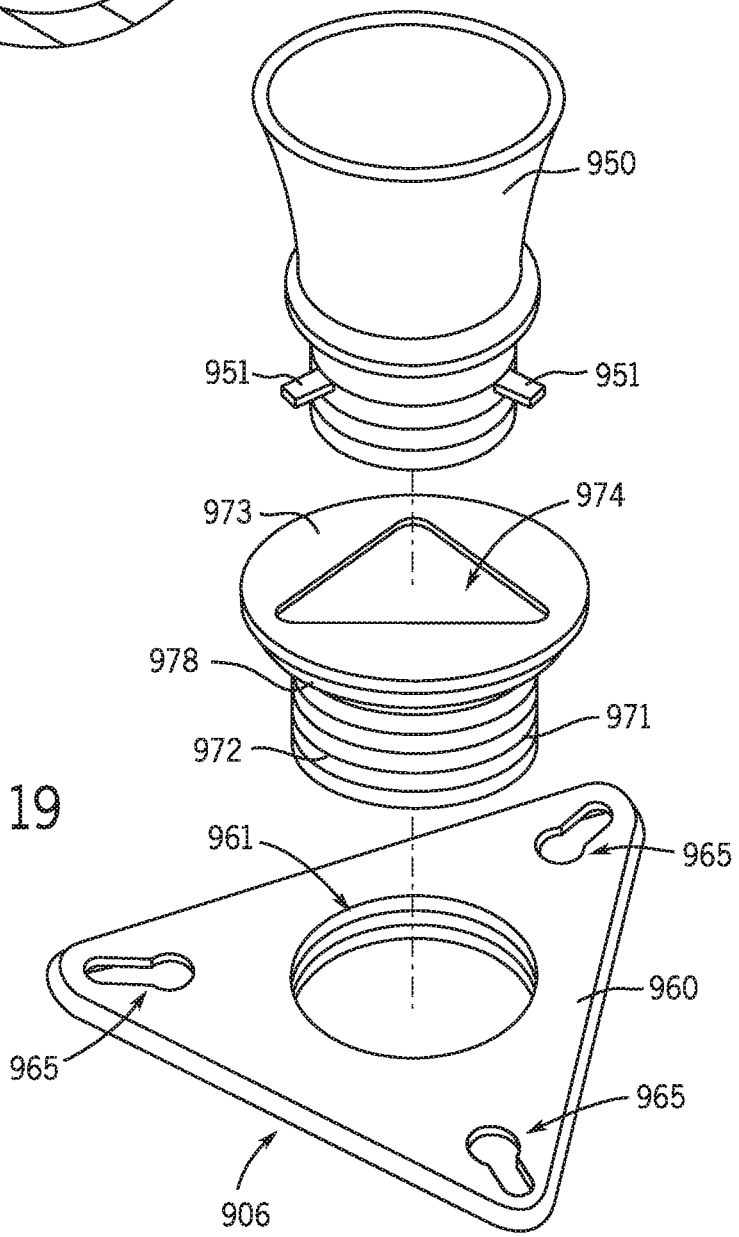
FIG. 19 is an exploded perspective partially exploded view of the mounting bracket shown in FIG. 18.

FIGS. 18 and 19 illustrate an exemplary embodiment of a mounting bracket 906 having a base 960 and a sleeve 970 that is separate from and connectable to the base 960. The base 960 includes a central opening 961 that is threaded (e.g., includes internal threads) to couple to external threads 971 of an end 972 of the sleeve 970. The sleeve 970 can include a head 973 (e.g., a flange) that extends radially out from the body of the sleeve 970 having the external threads 971, where the head 973 is configured to secure the mounting bracket 906 to a bottom 920 of a tank 902 by either directly contacting an inside of the bottom 920 or clamping a gasket 978 between the head 973 and the inside of the bottom 920. As shown in FIG. 18, the threaded end 972 of the sleeve 970 is configured to extend through an outlet opening 921 in the bottom 920 of the tank 902. The base 960 of the mounting bracket 906 can be screwed to the sleeve 970 to clamp the bottom 920 of the tank 902 between the head 973 of the sleeve 970 and the base 960 of the mounting bracket 906. As shown in FIG. 19, the mounting bracket 906 includes a plurality of mounting locations 965 (e.g., two, three, five, etc.) disposed in the base 960 for coupling the mounting bracket 906 to the pedestal 903 (e.g., toilet bowl). An optional gasket 977 can be employed between an underside of the base 960 and a topside of the pedestal 903 for sealing the inlet opening in the pedestal 903. The gasket 977 can couple directly to the sleeve 970, such as by threading to or sliding over the threaded end of the sleeve 970. The gasket 977 can have a generally flat shape or can have a shape that compliments an optional nut 979 (if provided). For example, the nut 979, if employed, can thread onto the end of the sleeve 970 to retain (e.g., clamp) the mounting bracket 906 and the bottom 920 between the head 973 and the nut 979. The head of the sleeve 970 can include an opening 974 that is configured to receive part of a flush valve. As shown in FIG. 19, the opening 974 is generally triangular in shape to receive a mating part of the valve body 950, which can be a triangular shape or three extensions (e.g., posts) 951 extending radially outward to form a triangular shape, which fits into the opening 974 and locks to the sleeve 970 upon a predetermined rotation relative thereto. Alternatively, the opening 974 in the sleeve 970 can be a threaded opening (e.g., like the sleeve 862 shown in FIG. 16), such as to receive a threaded portion (e.g., threaded end) of the valve body 950 upon assembly.

Figure 20:
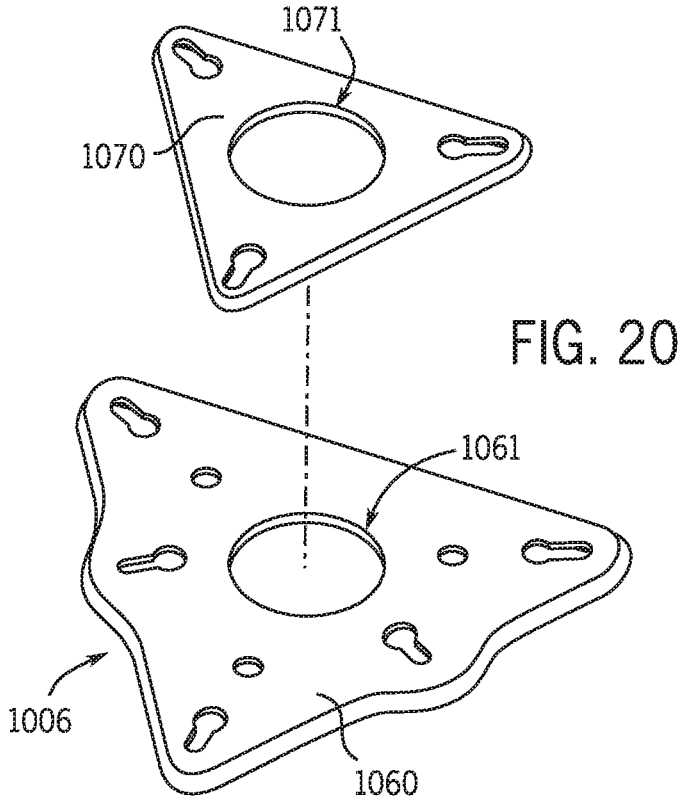
FIG. 20 is a perspective view of an exemplary embodiment of a mounting bracket.

FIG. 20 illustrates an exemplary embodiment of a universal mounting bracket 1006 having a base 1060 (e.g., body) having a three inch (3") flush valve hole 1061 and a plurality of mounting holes 1062. The mounting bracket 1006 is configured to optionally receive an insert 1070 having a two inch (2") flush valve hole 1071. The base 1060 and insert 1070 provide a universal attachment for both two inch and three inch flush valve systems. The insert 1070 can be coupled to the base 1060 using fasteners, welding, adhesives, other suitable devices, or a combination thereof. The mounting bracket 1006 includes any number of mounting locations, which can be disposed in either the base 1060 or the insert 1070.

Figure 21:
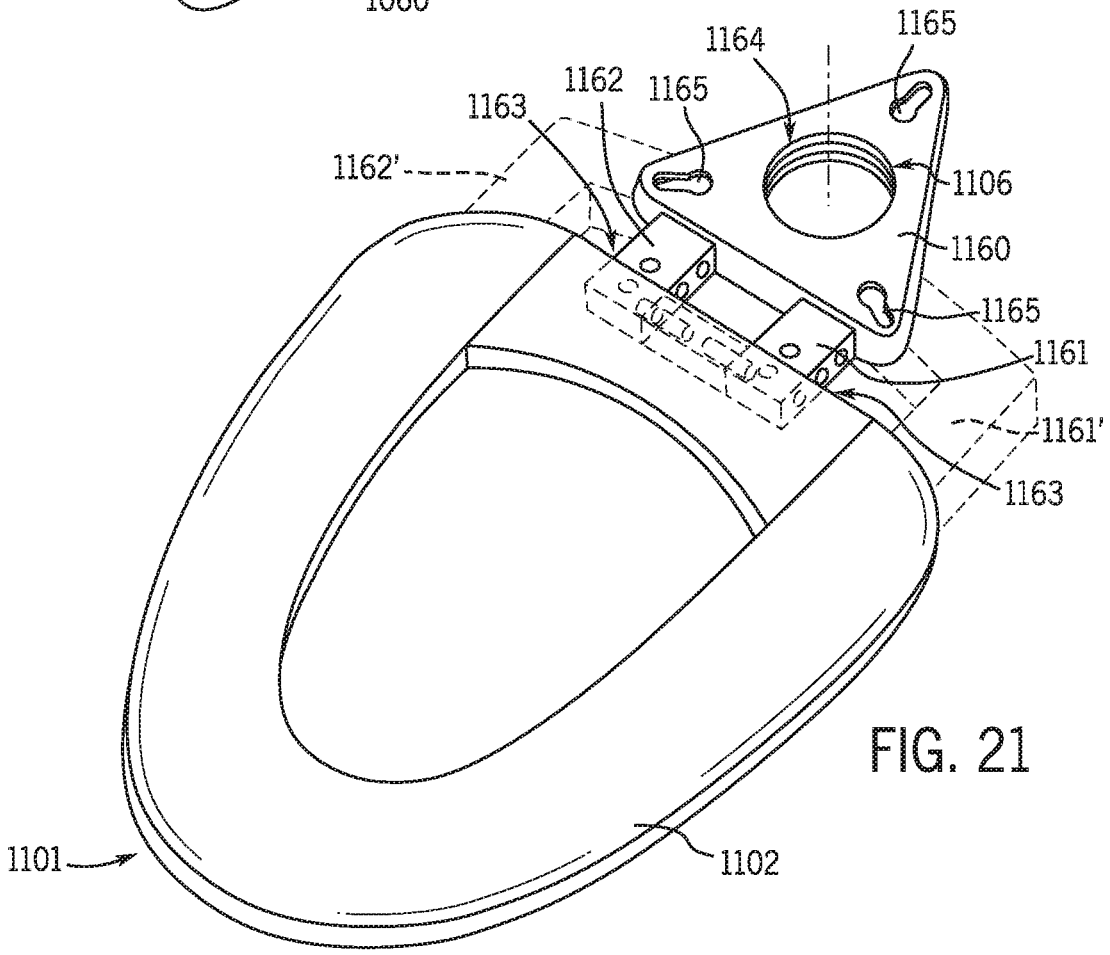
FIG. 21 is a perspective view of an exemplary embodiment of an integrated mounting bracket and toilet seat.

FIG. 21 illustrates an exemplary embodiment of an integrated mounting bracket and toilet seat assembly 1101. The assembly 1101 includes a toilet seat 1102 that is movably (e.g., pivotally, rotatably, slidably, etc.) coupled to a mounting bracket 1106 through a structure including one or more moving mechanisms 1163, such as hinges, slides, four-bar mechanisms, and the like. For example, the mechanism 1163 can include one or more hinges to pivotally couple the seat 1102 to the mounting bracket 1106. Also, for example, the mechanism 1163 can include one or more slides to slidably couple the seat 1102 to the mounting bracket 1106. Further, the moving mechanisms can be incorporated (e.g., built) into the toilet seat 1102 or the mounting bracket 1106. As shown, the mounting bracket 1106 includes a base 1160 and two arms 1161, 1162 extending away from a side of the base 1160. For example, one or more arms can extend from a front side (e.g., the arms 1161, 1162), a left side (e.g., arm 1162'), a right side (e.g., arm 1161'), a top side, any combination thereof, or any other side of the bracket. Each arm 1161, 1162 is coupled to the seat 1102 through a hinge 1163 to allow rotation of the seat 1102 relative to the arm. The coupling of the seat 1102 to the arm 1161, 1162 can be adjustable along the length of the arm, such as to move the seat along a fore and aft direction relative to the base 1160. A seat lid (not shown) can also be movably coupled to the mounting bracket 1106, such as through the arms 1161, 1162 and/or other elements of the assembly. The base 1160 includes a central opening 1164, which receives a valve body, and a plurality of mounting locations 1165 disposed on different sides of the central opening 1164. It is noted that the arms 1161, 1162 and hinges 1163 shown in FIG. 21 can be employed with any of the mounting brackets disclosed in this application.

Figure 22:
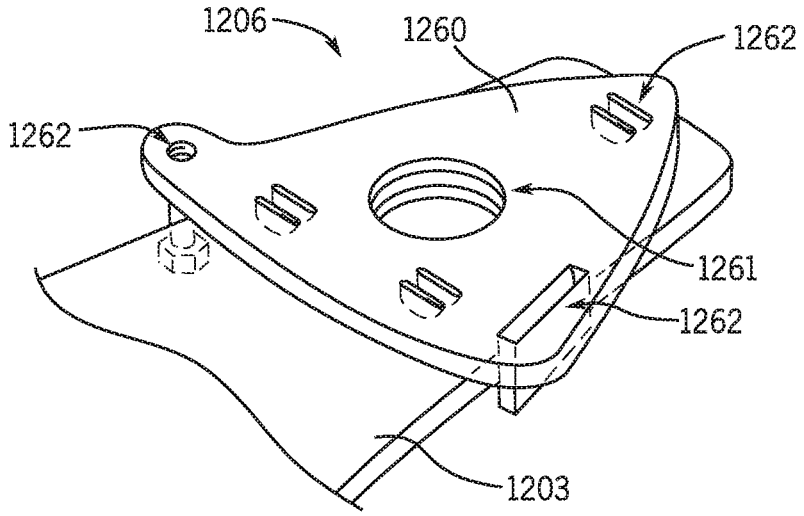
FIG. 22 is a perspective view of an exemplary embodiment of a mounting bracket on a pedestal.
Figure 23:
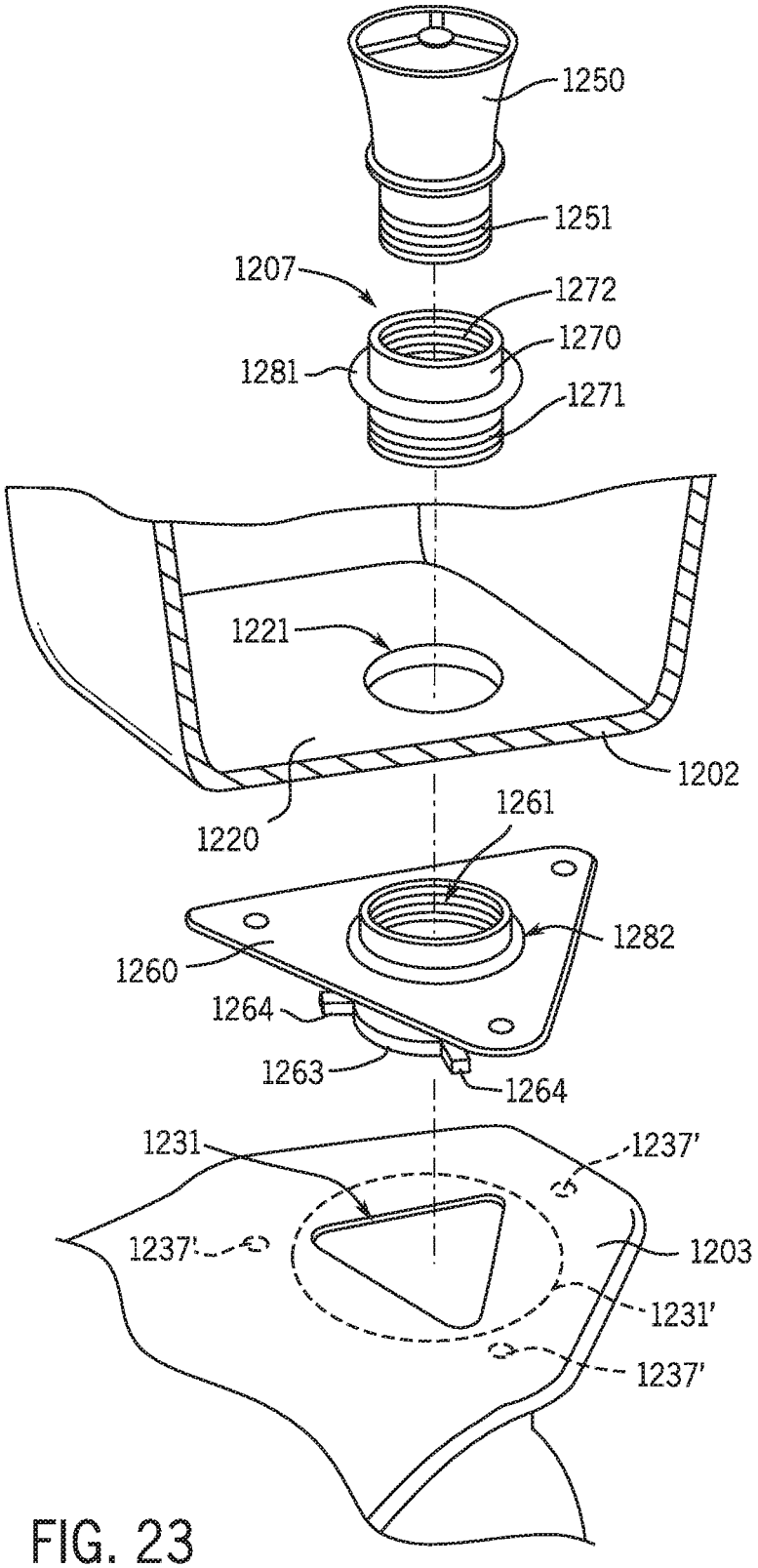
FIG. 23 is an exploded perspective view of a mounting system coupling a toilet tank to a toilet bowl.

FIGS. 22 and 23 illustrate a two piece mounting bracket 1206 and sleeve 1207 for securing a tank 1202 (e.g., toilet tank) to a pedestal 1203 (e.g., toilet bowl). The mounting bracket 1206 includes a base 1260 having a central opening 1261 and one or more mounting locations 1262 on one or more sides of the central opening 1261. Each attachment location 1262 can include one or more detent, fastener (e.g., that engage threaded holes), and/or other suitable coupling devices. The sleeve 1207 is separate from and connectable to the mounting bracket 1206, such as, for example, by threading external threads 1271 at an end of the body 1270 of the sleeve 1207 to internal threads defining the central opening 1261 in the base 1260. The sleeve 1207 can include external threads that thread to the mounting bracket 1206. The sleeve 1270 can include internal threads 1272 that thread to threads 1251 on a flush valve body 1250. Thus, the sleeve 1270 can be inserted through an outlet opening 1221 in a bottom 1220 of a tank 1202 from inside the tank 1202 and threaded to the mounting bracket 1206, which is provided external to (e.g., underneath) the tank 1202. Also shown in FIG. 23, the pedestal 1203 can include an inlet opening 1231 having a Wankel shape (i.e., a triangular opening with concave/convex sides that form three points/corners), such as to receive a Wankel shape attachment incorporated into the mounting bracket. For example, underneath the mounting bracket 1206 is a sleeve 1263 with three tabs 1264 (e.g., posts) extending radially outward form the sleeve 1263 forming a Wankel shaped attachment. The three tabs 1264 are configured to align with the three corners during assembly, such that the tabs 1264 and the sleeve 1263 can be inserted into the inlet opening 1231 when aligned with the corners. Once inserted, the tank 1202 and the mounting bracket 1206 together or further with the sleeve 1207 can be rotated relative to the pedestal 1203 to align the tabs 1264 with the concave/convex sides of the inlet opening 1231 to secure the tank 1202 in place relative to the pedestal 1203. Alternatively, the pedestal can include the Wankel shaped attachment and the mounting bracket can include the mating Wankel shaped hole. This system can be used, for example, without having holes (e.g., holes 1231', 1237') in the rear of the pedestal (e.g., the ledge) and, therefore, can provide a universal attachment system. Alternatively, the mounting bracket 1206 can be configured to be secured to the holes 1237' through fasteners and a circular shaped opening 1231' can be provided as the inlet into the pedestal. As yet another alternative, a set screw can be inserted into the pedestal and the mounting bracket 1206, or one or more detents can extend from one of the mounting bracket or the bowl to engage the other, such as to provide a travel (e.g., rotational) stop.

At least one embodiment of this application relates to a toilet that includes a tank having an outlet, a bowl having an inlet, a mounting bracket having a base and a sleeve, a fastener, and a valve body. The base is located between the tank and the bowl; and the base has a central opening and at least two mounting locations. The sleeve extends away from the base, is located concentric to the central opening, and has internal threads. A fastener is associated with each of the at least two mounting locations and is configured to engage the bowl to secure the mounting bracket to the bowl. The valve body extends through the outlet, the sleeve, and the central opening to fluidly connect the inlet of the bowl to the tank, and the valve body has external threads that thread to the internal threads of the sleeve to secure the valve body and the tank to the mounting bracket.

The sleeve can be configured to extend away from a top of the base and through the outlet in the tank.

The toilet can, optionally, include a valve nut that is disposed inside the tank and that threads to external threads on the sleeve to secure the mounting bracket to the tank.

The toilet can, optionally, include a gasket that is located between the valve nut, a bottom of the tank, and the sleeve.

The sleeve and the base can be integrally formed as a single element, such as, for example, where the mounting bracket is rigid.

The sleeve can be formed separately from the base and configured to thread to threads defining the central opening of the base.

The toilet can, optionally, include a gasket, wherein a head is disposed on an end of the sleeve that is located in the tank upon assembly, and the gasket is located between the head of the sleeve and a bottom of the tank.

The sleeve can be configured to extend away from a bottom of the base and toward the inlet of the bowl.

The sleeve can be configured to extend into the inlet of the bowl.

The toilet can, optionally, include a gasket that is located around the sleeve and between the base and the bowl.

The sleeve can be formed separately from the base and includes external threads that thread to internal threads in the central opening of the base.

At least one embodiment of this application relates to a toilet mounting assembly that includes a mounting bracket and a fastener. The mounting bracket includes a base and a sleeve. The base is configured to be located between a toilet tank and a toilet bowl; and the base has a central opening and at least two mounting locations. The sleeve extends away from the base, is located concentric to the central opening, and has internal threads that are configured to thread to a valve body. A fastener is associated with each of the at least two mounting locations and is configured to engage the toilet bowl to secure the mounting bracket to the toilet bowl.

The sleeve can be configured to extend away from a top of the base and can be configured to extend through an outlet in a bottom of the toilet tank.

The toilet can, optionally, include a valve nut that is configured to be located inside the toilet tank, wherein the valve nut threads to external threads on the sleeve to secure the mounting bracket to the toilet tank with the bottom of the toilet tank located between the valve nut and the base of the mounting bracket.

The toilet can, optionally, include a gasket that is configured to be located between the valve nut, the bottom of the toilet tank, and the sleeve of the mounting bracket.

The sleeve can be configured to extend away from a bottom of the base of the mounting bracket, such as, for example, where the sleeve extends into an inlet of the toilet bowl upon assembly.

The toilet can, optionally, include a gasket located around the sleeve between an underside of the base of the mounting bracket and a topside of the toilet bowl.

The sleeve of the mounting bracket can be formed separately from the base of the mounting bracket, such as, for example, where the sleeve includes external threads that thread to internal threads in the central opening of the base to connect the sleeve and the base together.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the toilets and toilet couplings as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., mounting bracket, valve body, gasket, mounting location, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A toilet comprising:

a tank having an outlet in a bottom;

a universal mounting bracket comprising:

a base having a central opening;

a first set of mounting locations, which comprises two mounting locations that are located on opposite sides of the central opening and are configured to mount the tank to a first pedestal having a bowl and two mounting holes;

a second set of mounting locations, which comprises first, second, and third mounting locations that are separate from the two mounting locations of the first set of mounting locations, are located in a triangular pattern around the central opening, and are configured to mount the tank to a second pedestal having a bowl and three mounting holes;

a first tab located on a front side of the base that is opposite the third mounting location;

a second tab located on a first side of the base that is adjacent to the third mounting location; and a third tab located on a second side of the base that is adjacent to the third mounting location;

a valve body extending through the outlet and the central opening, wherein the valve body is configured to fluidly connect the outlet of the tank to an inlet of one of the bowls; and two or more fasteners with each fastener engaging one mounting hole and an associated mounting location to secure the mounting bracket to associated pedestal.

2. The toilet of claim 1, wherein a first mounting location of the first set of mounting locations is located adjacent to the first mounting location of the second set of mounting locations, and a second mounting location of the first set of mounting locations is located adjacent to the second mounting location of the second set of mounting locations.

3. The toilet of claim 2, wherein the third mounting location of the second set of mounting locations is located adjacent to a rearward edge of the base.

4. The toilet of claim 1, wherein the third mounting location is substantially aligned with a center of the central opening in a fore and aft direction.

5. The toilet of claim 4, wherein the first and second mounting locations of the first set of mounting locations are substantially aligned with the center of the central opening in a lateral direction.

6. The toilet of claim 5, wherein the first and second mounting locations of the second set of mounting locations are provided forward of the first and second mounting locations of the first set of mounting locations in the fore and aft direction.

7. The toilet of claim 6, wherein the mounting bracket further comprises an arm extending away from the base, wherein the arm is configured to couple to a toilet seat through a hinge that movably connects the toilet seat to the mounting bracket.

8. The toilet of claim 1, wherein the mounting bracket comprises an arm extending away from the base, wherein the arm is configured to couple to a toilet seat through a hinge that movably connects the toilet seat to the mounting bracket.

9. The toilet of claim 8, wherein the arm is a first arm and the mounting bracket further comprises a second arm, which is spaced apart from the first arm in a lateral direction, wherein the first arm extends from a first side of a forward portion of the base, which is proximate a first mounting location of the second set of mounting locations, wherein the second arm extends from a second side of the forward portion of the base, which is proximate a second mounting location of the second set of mounting locations, and wherein each arm is configured to couple to the toilet seat through an associated hinge.

10. A toilet comprising:

a tank;

a pedestal having a ledge, a bowl, and an inlet fluidly connected to the bowl;

a universal mounting bracket comprising:

a base having at least two mounting locations; and an arm extending away from the base;

a fastener engaging each mounting location of the mounting bracket and an associated mounting hole in the ledge to secure the mounting bracket to the pedestal;

a seat movably coupled to the arm through a hinge, such that the seat is movable relative to the mounting bracket and pedestal; and a valve body that is fixed relative to the base of the mounting bracket.

11. The toilet of claim 10, wherein the valve body extends through an outlet of the tank and a central opening in the base of the mounting bracket, wherein the valve body is configured to fluidly connect the outlet to the inlet of the pedestal.

12. The toilet of claim 11, wherein the valve body threads to threads defining the central opening in the base.

13. The toilet of claim 11, wherein the arm is a first arm and the mounting bracket further comprises a second arm, which is spaced apart from the first arm in a lateral direction, wherein the first arm extends from a first side of a forward portion of the mounting bracket, wherein the second arm extends from a second side of the forward portion, and wherein each arm is configured to couple to the seat through an associated hinge.

14. The toilet of claim 13, wherein the mounting bracket includes a flange that extends around at least a portion of the base, and the forward portion is part of the flange.

15. The toilet of claim 13, wherein the at least two mounting locations comprises:

a first set of mounting locations comprising two mounting locations that are located on opposite sides of the central opening and are configured to mount the tank to a two mount pedestal having two mounting holes; and a second set of mounting locations comprising three mounting locations that are separate from the two mounting locations of the first set of mounting locations, are located in a triangular pattern around the central opening, and are configured to mount the tank to a three mount pedestal having three mounting holes.

16. The toilet of claim 15, wherein the first side of the forward portion of the base is located proximate a first mounting location of the second set of mounting locations, and the second side of the forward portion of the base is located proximate a second mounting location of the second set of mounting locations.

17. A toilet, comprising:

a tank;

a pedestal having a ledge, a bowl, and an inlet fluidly connected to the bowl;

a universal mounting bracket comprising:

a base having at least two mounting locations; and an arm extending away from the base;

a fastener engaging each mounting location of the mounting bracket and an associated mounting hole in the ledge to secure the mounting bracket to the pedestal;

a seat movably coupled to the arm through a hinge, such that the seat is movable relative to the mounting bracket and pedestal; and a valve body extending through an outlet of the tank and a central opening in the base of the mounting bracket, wherein the valve body is configured to fluidly connect the outlet to the inlet of the pedestal, wherein the mounting bracket comprises a sleeve that extends away from a bottom of the base and toward the inlet of the pedestal, and wherein the valve body threads to the sleeve to secure the valve body and the tank to the mounting bracket.

18. A toilet, comprising:

a tank;

a pedestal having a ledge, a bowl, and an inlet fluidly connected to the bowl;

a universal mounting bracket comprising:

a base having at least two mounting locations; and an arm extending away from the base;

a fastener engaging each mounting location of the mounting bracket and an associated mounting hole in the ledge to secure the mounting bracket to the pedestal;

a seat movably coupled to the arm through a hinge, such that the seat is movable relative to the mounting bracket and pedestal; and a valve body extending through an outlet of the tank and a central opening in the base of the mounting bracket, wherein the valve body is configured to fluidly connect the outlet to the inlet of the pedestal, wherein the mounting bracket comprises a sleeve that extends away from a top of the base and toward the outlet of the tank, and wherein the valve body threads to the sleeve to secure the valve body and the tank to the mounting bracket.

19. The toilet of claim 10, wherein the at least two mounting locations comprises:

a first set of mounting locations comprising two mounting locations that are located on opposite sides of a central opening in the base and are configured to mount the tank to a two mount pedestal having two mounting holes; and a second set of mounting locations comprising three mounting locations that are separate from the two mounting locations of the first set of mounting locations, are located in a triangular pattern around the central opening, and are configured to mount the tank to a three mount pedestal having three mounting holes.

20. The toilet of claim 1, wherein the mounting bracket comprises a sleeve that extends away from a bottom or a top of the base, wherein the valve body threads to the sleeve to secure the valve body and the tank to the mounting bracket.

21. The toilet of claim 10, wherein the valve body threads to the base of the mounting bracket.

* * * * *